US011118743B2

(12) United States Patent
Shan et al.

(10) Patent No.: US 11,118,743 B2
(45) Date of Patent: Sep. 14, 2021

(54) ELECTRODELESS SURFACE-MOUNTED LED STRING LIGHT, METHOD AND APPARATUS FOR MANUFACTURING THE SAME

(71) Applicant: Zhuhai Bojay Electronics Co. Ltd., Guangdong (CN)

(72) Inventors: Xiwan Shan, Guangdong (CN); Tuxiu Yang, Guangdong (CN); Yundong Ai, Guangdong (CN); Jie Zhang, Guangdong (CN); Qunlin Li, Guangdong (CN); Qiming Liu, Guangdong (CN); Su Yan, Guangdong (CN); Yanyong Liu, Guangdong (CN); Junchao He, Guangdong (CN); Jiahui Cai, Guangdong (CN); Yue Chen, Guangdong (CN)

(73) Assignee: Zhuhai Bojay Electronics Co. Ltd., Guangdong (CN)

( * ) Notice: Subject to any disclaimer, the term of this patent is extended or adjusted under 35 U.S.C. 154(b) by 0 days.

(21) Appl. No.: 16/888,222

(22) Filed: May 29, 2020

(65) Prior Publication Data

US 2021/0071828 A1 Mar. 11, 2021

(30) Foreign Application Priority Data

Sep. 6, 2019 (CN) ..... 201910843987.6

(51) Int. Cl.
*F21S 4/26* (2016.01)
*F21K 9/20* (2016.01)
(Continued)

(52) U.S. Cl.
CPC ..... *F21S 4/26* (2016.01); *F21K 9/20* (2016.08); *F21K 9/90* (2013.01); *F21V 19/002* (2013.01);
(Continued)

(58) Field of Classification Search
CPC .. F21S 4/26; F21S 4/10; F21V 19/002; F21V 23/001; F21V 23/06; F21K 9/20;
(Continued)

(56) References Cited

U.S. PATENT DOCUMENTS 7,926,978 B2 4/2011 Tsai
10,281,094 B2 5/2019 Liu
(Continued)

FOREIGN PATENT DOCUMENTS

CN 201688230 U 12/2010
CN 203560768 U 4/2014
(Continued)

OTHER PUBLICATIONS

Claims of copending U.S. Appl. No. 16/888,286; Shan et al.; (Year: 2020).*
(Continued)

*Primary Examiner* — Rajarshi Chakraborty
*Assistant Examiner* — Glenn D Zimmerman
(74) *Attorney, Agent, or Firm* — Adsero IP

(57) ABSTRACT

An electrodeless surface-mounted LED string light, a method and an apparatus for manufacturing the same are disclosed. The electrodeless surface-mounted LED string light includes: a first wire and a second wire; a plurality of LED units, wherein each LED units includes two surface-mounted LEDs, and luminous surfaces of the two surface-mounted LEDs are opposite to each other, and the luminous surfaces of the two surface-mounted LEDs are parallel to an axial direction of the first and second wires; and a plurality of encapsulants respectively encapsulating the two surface-mounted LEDs of the plurality of LED units therein.

3 Claims, 6 Drawing Sheets

(51) Int. Cl.

| | |
|---|---|
| ***F21K 9/90*** | (2016.01) |
| ***F21V 19/00*** | (2006.01) |
| ***F21V 23/00*** | (2015.01) |
| *F21Y 113/13* | (2016.01) |
| *F21Y 103/10* | (2016.01) |
| *F21Y 115/10* | (2016.01) |

(52) U.S. Cl.
CPC ..... *F21V 23/001* (2013.01); *F21Y 2103/10* (2016.08); *F21Y 2113/13* (2016.08); *F21Y 2115/10* (2016.08)

(58) Field of Classification Search
CPC .... F21K 9/90; F21Y 2103/10; F21Y 2115/10; F21Y 2113/13; F21Y 2107/90; B23K 3/00; B23K 3/08
See application file for complete search history.

(56) References Cited

U.S. PATENT DOCUMENTS

| | | | | |
|---|---|---|---|---|
| 10,920,941 | B1 | 2/2021 | Shan et al. | |
| 2002/0089859 | A1 | 7/2002 | Jackson et al. | |
| 2005/0207151 | A1 | 9/2005 | Aanegola et al. | |
| 2007/0208395 | A1* | 9/2007 | Leclerc | A61N 5/0616 607/86 |
| 2008/0200089 | A1 | 8/2008 | Tsai | |
| 2011/0310601 | A1 | 12/2011 | Shao | |
| 2014/0009074 | A1 | 1/2014 | Chen | |
| 2014/0268818 | A1 | 9/2014 | Huang et al. | |
| 2015/0077999 | A1 | 3/2015 | Chen | |
| 2017/0328527 | A1* | 11/2017 | Yang | H01L 27/156 |
| 2017/0336037 | A1 | 11/2017 | Chien | |
| 2018/0119929 | A1 | 5/2018 | Weiss | |
| 2019/0069649 | A1 | 3/2019 | Qin | |
| 2019/0101254 | A1 | 4/2019 | Tsai | |
| 2019/0234597 | A1* | 8/2019 | Zhu | F21V 23/002 |
| 2019/0277458 | A1* | 9/2019 | Shao | F21V 19/0025 |
| 2019/0368670 | A1 | 12/2019 | Gao | |
| 2019/0376669 | A1* | 12/2019 | Shao | F21V 19/005 |
| 2020/0278091 | A1* | 9/2020 | Chen | H01L 33/36 |
| 2021/0071827 | A1 | 3/2021 | Shan et al. | |
| 2021/0071829 | A1 | 3/2021 | Shan et al. | |
| 2021/0071850 | A1 | 3/2021 | Shan et al. | |
| 2021/0071852 | A1 | 3/2021 | Shan et al. | |
| 2021/0071854 | A1 | 3/2021 | Shan et al. | |
| 2021/0071828 | A1 | 6/2021 | Shan et al. | |

FOREIGN PATENT DOCUMENTS

| | | | |
|---|---|---|---|
| CN | 203571516 | U | 4/2014 |
| CN | 203771161 | U | 8/2014 |
| CN | 204328616 | U | 5/2015 |
| CN | 206496230 | U | 9/2017 |
| CN | 107559646 | A | 1/2018 |
| CN | 207539677 | U | 6/2018 |
| CN | 110617414 | A | 12/2019 |
| GB | 2586903 | A | 6/2020 |
| KR | 10-1629749 | B1 | 6/2016 |
| WO | WO-2019-041745 | A1 | 3/2019 |

OTHER PUBLICATIONS

U.S. Appl. No. 16/888,282 Non-Provisional Application, filed May 29, 2020, 36 pages.
U.S. Appl. No. 16/888,286 Non-Provisional Application, filed May 29, 2020, 36 pages.
U.S. Appl. No. 16/888,290 Non-Provisional Application, filed May 29, 2020, 31 pages.
U.S. Appl. No. 16/888,296 Non-Provisional Application, filed May 29, 2020, 39 pages.
GB Application No. GB2006270.9, Examination Report dated Jun. 12, 2020, 1 page.
GB Application No. GB2006270.9, Search Report dated Jun. 11, 2020, 1 page.
U.S. Appl. No. 17/002,105 Non-Provisional Application, filed Aug. 25, 2020, 72 pages.
GB Application No. GB2006267.5, Examination Report dated Jun. 12, 2020, 2 pages.
GB Application No. GB2007273.2, Examination Report dated Jun. 15, 2020, 2 pages.
GB Application No. GB2006271.7, Examination Report dated Jun. 12, 2020, 2 pages.
U.S. Appl. No. 16/888,282 Non-Final Office Action, dated Mar. 8, 2021, 95 pages.
Extended European Search Report, Application No. 20194300.8, dated Feb. 9, 2021, 8 pages.
U.S. Appl. No. 16/888,290 Notice of Allowance, dated Nov. 13, 2020, 20 pages.
U.S. Appl. No. 16/888,282 Office Action—Restriction Requirement, dated Dec. 18, 2020, 7 pages.
U.S. Appl. No. 16/888,286 Non-Final Office Action dated Jan. 27, 2021, 27 pages.
Canadian Application No. 3080041, Office Action, dated Jun. 29, 2021, 6 pages.
U.S. Appl. No. 16/888,286 Final Office Action dated Jul. 16, 2021, 28 pages.

* cited by examiner

ELECTRODELESS SURFACE-MOUNTED LED STRING LIGHT, METHOD AND APPARATUS FOR MANUFACTURING THE SAME

CROSS-REFERENCE TO RELATED APPLICATION

The present application claims the benefit of Chinese Patent Application No. 2019108439876, filed on Sep. 6, 2019, the entire content of which is incorporated herein in its entirety.

TECHNICAL FIELD

The present disclosure relates to a field of lightings, in particular, to an electrodeless surface-mounted LED string light, and a method and an apparatus for manufacturing the same.

BACKGROUND

A LED string light is a type of decorative lighting including light bulbs, wires, etc. therein, widely used in decoration, architecture, landscape industries and the like. The LED string light is more popular because of its advantages such as energy-saving, environmental protection, beautiful appearance, low price and the like. Conventional LED string light typically consists of two side-by-side wires and a number of surface-mounted LEDs encapsulated on the wires. The LED string light is welded with one LED in one assembly position, and thus the utilization rate of the wire is not high, which causes great waste of manpower, raw materials and apparatus. Moreover, the LEDs are unipolar, and when they are used, positive and negative electrodes of the string light need to correspond to positive and negative electrodes of a drive power, which is inconvenient to use.

SUMMARY

As for the above condition of the prior art, the present disclosure provides an electrodeless surface-mounted LED string light with high wire utilization rate and convenient use. The present disclosure also provides a method and an apparatus for manufacturing the electrodeless surface-mounted LED string light.

For solving the above technical problems, the present disclosure provides an electrodeless surface-mounted LED string light including:

a first wire and a second wire arranged side by side or intertwisted with each other, wherein each of the first wire and the second wire includes a wire core and an insulating layer covered on a surface of the wire core, a plurality of first welding spots are formed by removing the insulating layer of the first wire at a set interval along an axial direction thereof, a plurality of second welding spots are formed by removing the insulating layer of the second wire at a set interval along an axial direction thereof, and wherein positions of the plurality of the second welding spots are in one-to-one correspondence with positions of the plurality of the first welding spots so as to form a plurality of welding light regions;

a plurality of LED units disposed at the plurality of welding light regions, respectively, wherein each LED unit includes a first surface-mounted LED and a second surface-mounted LED, and wherein a luminous surface of the first surface-mounted LED is opposite to a luminous surface of the second surface-mounted LED, and wherein the luminous surface of the first surface-mounted LED faces an upper side of the welding light regions, the luminous surface of the second surface-mounted LED faces a lower side of the welding light regions, and wherein positions of positive electrodes and negative electrodes of the first surface-mounted LED and the second surface-mounted LED are oppositely disposed, and wherein two weld legs of the first surface-mounted LED and the second surface-mounted LED of each LED unit are respectively welded onto the first and second welding spots of the corresponding welding light region; and a plurality of encapsulants respectively covered on surfaces of the two surface-mounted LEDs of the plurality of LED units, to form a plurality of lighting beads.

According to the electrodeless surface-mounted LED string light, each welding light region is welded with two surface-mounted LEDs, and thus the utilization rate of the lighting wire of the string light is improved, the utilization rates of raw materials and apparatus are improved, and the product quality and manufacturing efficiency are improved. In addition, the positive and negative electrodes of the two surface-mounted LEDs are opposite. In this way, when the positive current is applied, one of the surface-mounted LEDs is illuminated, the other surface-mounted LED is not illuminated, and when the reverse current is applied, the one of the surface-mounted LEDs is not illuminated, the other surface-mounted LED is illuminated. Therefore, a non-polar effect is achieved, and it is convenient to be used. Moreover, the two surface-mounted LEDs can be disposed to have different colors, such that the colors thereof may be changed by changing the current direction. When the alternating current is applied, color mixing effect of any two colors may be accomplished according to the surface-mounted LED and the applied phosphor thereon.

In one of the embodiments, the two surface-mounted LEDs of the LED units are provided to have different colors.

In one of the embodiments, the first wire and the second wire are rubber wires or enameled wires.

A method for manufacturing an electrodeless surface-mounted LED string light provided by the present disclosure includes:

supplying a first wire and a second wire by a wire supply mechanism;

transporting the first wire and the second wire to a stripping station by a wire transporting mechanism, forming first and second welding spots by stripping off insulating layers of the first wire and the second wire respectively at a set interval through a wire stripping mechanism, wherein positions of the first welding spots are in one-to-one correspondence with positions of the second welding spots so as to form welding light regions;

transporting the first welding spots and the second welding spots to a spot-welding material station by the wire transporting mechanism, applying welding materials to surfaces of the first welding spots and the second welding spots by a spot-welding material mechanism;

transporting the first welding spots and the second welding spots of which surfaces are applied with the welding materials to a LED surface-mounting station by the wire transporting mechanism, placing first and second surface-mounted LEDs at the welding light regions by a LED placing mechanism, wherein luminous surfaces of the first surface-mounted LEDs are opposite to luminous surfaces of the second surface-mounted LEDs, and the luminous surfaces of the first surface-mounted LEDs face an upper side of the welding light regions, the luminous surface of the second surface-mounted LED faces a lower side of the welding light regions, and wherein positions of positive electrodes and negative electrodes of the first surface-mounted LED and the second surface-mounted LED are disposed to be opposite;

transporting the first surface-mounted LEDs and the second surface-mounted LEDs to a welding station by the wire transporting mechanism, welding two weld legs of the first surface-mounted LED and the second surface-mounted LED onto the first welding spot and the second welding spot, respectively;

transporting the welded first surface-mounted LEDs and the welded second surface-mounted LEDs to a welding detection station by the wire transporting mechanism, detecting welding quality of the first surface-mounted LEDs and the second surface-mounted LEDs by a welding detection mechanism; and transporting the first surface-mounted LEDs and the second surface-mounted LEDs after detecting to an encapsulating station by the wire transporting mechanism, and encapsulating the first surface-mounted LEDs and the second surface-mounted LEDs in encapsulants by an encapsulating mechanism to form lighting beads.

In one embodiment, the placing the first and second surface-mounted LEDs at the welding light regions by the LED placing mechanism includes:

supplying the first surface-mounted LEDs with luminous surfaces facing upward by a first feeding assembly;

suctioning, by a robotic suction assembly, the first surface-mounted LEDs from the first feeding assembly, and surface-mounting the first surface-mounted LEDs at the upper side of the welding light regions;

supplying the second surface-mounted LEDs with luminous surfaces facing downward by a second feeding assembly;

suctioning, by the robotic suction assembly, the second surface-mounted LEDs from the second feeding assembly, and surface-mounting the second surface-mounted LEDs at a transition location; and acquiring, by a second surface-mounted LED surface-mounting assembly, the second surface-mounted LEDs from the transition location and surface-mounting the second surface-mounted LEDs at the lower side of the welding light regions.

In one embodiment, the first surface-mounted LEDs and the second surface-mounted LEDs are provided to have different colors.

An apparatus for manufacturing an electrodeless surface-mounted LED string light by the present disclosure includes:

a wire supply mechanism, configured to supply a first wire and a second wire side by side;

a wire stripping mechanism, configured to strip off insulating layers on surfaces of the first wire and the second wire at a set interval to form first and second welding spots, and wherein the first welding spots are in one-to-one correspondence with the second welding spots to form welding light regions;

a spot-welding material mechanism, configured to apply welding materials onto surfaces of the first welding spots and the second welding spots;

a LED placing mechanism, configured to place first surface-mounted LEDs and second surface-mounted LEDs at the welding light regions, wherein luminous surfaces of the first surface-mounted LEDs are opposite to luminous surfaces of the second surface-mounted LEDs, and wherein the luminous surfaces of the first surface-mounted LEDs face an upper side of the welding light regions, and the luminous surfaces of the second surface-mounted LEDs face a lower side of the welding light regions, and wherein positions of positive electrodes and negative electrodes of the first surface-mounted LED and the second surface-mounted LED are oppositely disposed;

a welding mechanism, configured to weld two weld legs of the first surface-mounted LED and the second surface-mounted LED onto the first welding spot and the second welding spot, respectively;

a detection mechanism, configured to detect welding quality of the first surface-mounted LEDs and the second surface-mounted LEDs;

an encapsulating mechanism, configured to encapsulate the first surface-mounted LEDs and the second surface-mounted LEDs in encapsulants to form lighting beads; and a wire transporting mechanism, configured to transport the first wire and the second wire.

In one embodiment, the LED placing mechanism includes:

a first feeding assembly, configured to supply the first surface-mounted LEDs with luminous surfaces facing upward;

a second feeding assembly, configured to supply the second surface-mounted LEDs with luminous surfaces facing downward;

a robotic suction assembly, configured to suction the first surface-mounted LEDs from the first feeding assembly and surface-mount the first surface-mounted LEDs on the upper side of the welding light regions, and further configured to suction the second surface-mounted LEDs from the second feeding assembly and place the second surface-mounted LEDs at a transition location; and a second surface-mounted LED surface-mounting assembly, configured to acquire the second surface-mounted LEDs from the transition location and surface-mount the second surface-mounted LEDs at the lower side of the welding light regions.

In one embodiments, the second surface-mounted LED surface-mounting assembly includes a positioning block and a positioning block driving device, and wherein the positioning block is provided with a placement site for placing the second surface-mounted LEDs, and the positioning block is movable between the transition location and a surface-mounting location, and wherein the positioning block driving device is configured to drive the positioning block to move between the transition location and the surface-mounting location.

In one embodiment, the positioning block is further provided with positioning slots for positioning the first wire and the second wire.

The advantageous effects of the additional technical features of the present disclosure will be illustrated in detailed description of the present specification.

10—a support frame, 20—a supply mechanism, 30—a wire stripping mechanism, 40—a wire transporting mechanism, 50—a spot-welding material mechanism, 60—a LED placing mechanism, 61—a first feeding assembly, 62—a second feeding assembly, 63—a robotic suction assembly, 631—an suction rod, 632—a robot, 64—a second surface-mounted LED surface-mounting assembly, 641—a positioning block, 641*a*—a positioning slot, 642—a translation cylinder, 643—a lifting cylinder, 644—a fixed base; 645—a holder, 70—a welding mechanism, 80—a detection mechanism, 90—an encapsulating mechanism, 901—an encapsulant spot-applying mechanism, 902—a curing mechanism, 110—a terminal processing mechanism, 111—a wire take-up wheel, 112—a wire take-up motor, 120—a LED string light, 121—a first wire, 122—a second wire, 123—a first surface-mounted LED, 124—a second surface-mounted LED, 125—encapsulant.

DETAILED DESCRIPTION OF THE EMBODIMENTS

The disclosure will be described in detail hereinafter with reference to the accompanying drawings in conjunction with the embodiments. It should be noted that the features in the following embodiments may be combined with each other without conflict.

The upper, lower, left, and right in the embodiment are used only for convenience of description, and are not intended to limit the scope of the present disclosure, and the change or adjustment of the relative relationship in the embodiment should be considered as be fallen in the scope of the present disclosure.

Figure 1:
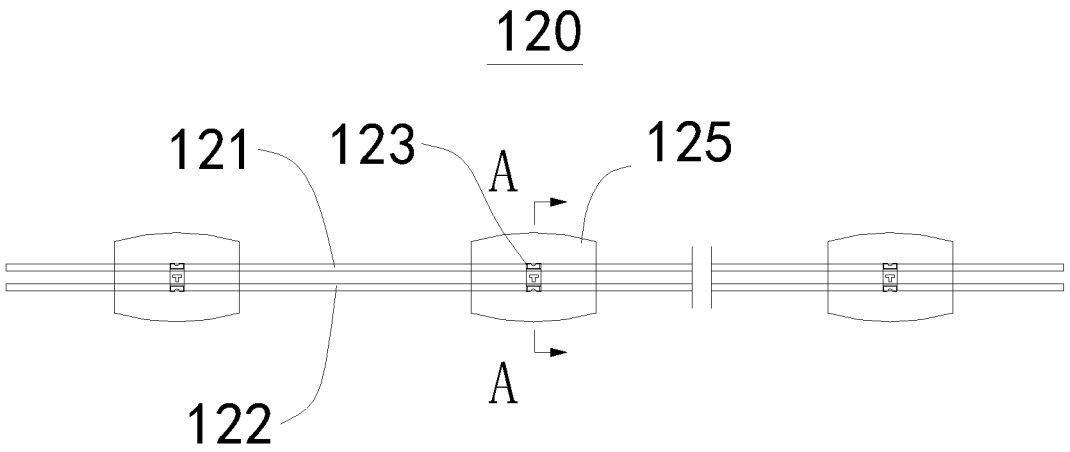
FIG. 1 is a structural schematic view of an electrodeless surface-mounted LED string light in one of embodiments of the present disclosure.
Figure 2:
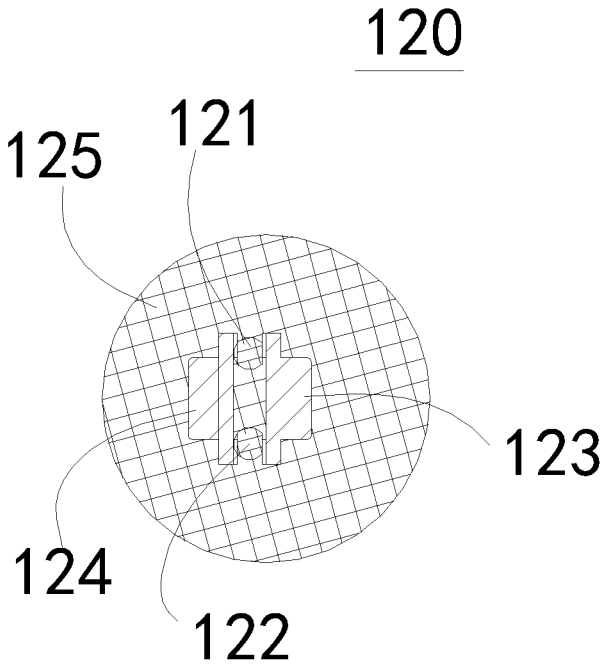
FIG. 2 is a section view taken in line A-A in FIG. 1.

FIGS. 1 and 2 show an electrodeless surface-mounted LED string light 120, the electrodeless surface-mounted LED string light 120 includes a first wire 121, a second wire 122, a plurality of LED units and a plurality of encapsulants 125. The first wire 121 and the second wire 122 are arranged side by side. The first wire 121 and the second wire 122 each include a wire core (not shown in figures) and an insulating layer (not shown in figures) covered on the surface of the wire core. The first wire 121 and the second wire 122 in the embodiment may be rubber wires or enameled wires. A plurality of first welding spots (not shown in figures) and a plurality of second welding spots (not shown in figures) are formed by removing insulating layers of the first wire 121 and the second wire 122 at a set interval along an axial direction thereof, respectively. The positions of the plurality of second welding spots are in one-to-one correspondence with the positions of the plurality of first welding spots, to form a plurality of welding light regions. A plurality of LED units are disposed at the plurality of welding light regions, respectively. Each LED unit includes a first surface-mounted LED 123 and a second surface-mounted LED 124 of which luminous surfaces are opposite to each other. The luminous surface of the first surface-mounted LED 123 faces the upper side of the welding light regions, the luminous surface of the second surface-mounted LED 124 faces the lower side of the welding light regions. The positions of the positive electrodes and the negative electrodes of the first surface-mounted LED 123 and the second surface-mounted LED 124 are oppositely disposed. The two weld legs of the first surface-mounted LED 123 and the second surface-mounted LED 124 of each LED unit are respectively welded onto the first and second welding spots of the corresponding welding light region. The plurality of encapsulants 125 are respectively applied on the surfaces of the first surface-mounted LEDs 123 and the second surface-mounted LEDs 124 of the plurality of LED units, to form a plurality of lighting beads.

In one embodiment, the first surface-mounted LEDs 123 and the second surface-mounted LEDs 124 are provided to have different colors.

According to the electrodeless surface-mounted LED string light, each welding light region is welded with two surface-mounted LEDs, and thus the utilization rate of the lighting wire of the string light is improved, the utilization rates of raw materials and apparatus are improved, the product quality and manufacturing efficiency are improved. In addition, the positive and negative electrodes of the two surface-mounted LEDs are opposite. In this way, when the positive current is applied, one of the surface-mounted LEDs is illuminated, the other surface-mounted LED is not illuminated, and when the reverse current is applied, the one of the surface-mounted LEDs is not illuminated, the other surface-mounted LED is illuminated. Therefore, a non-polar effect is achieved, and it is convenient to be used. In addition, the two surface-mounted LEDs may be provided with different colors, such that the colors thereof may be changed by changing the direction in which the current is applied. For example, when the alternating current is applied, color mixing effect of any two colors may be accomplished according to the surface-mounted LED and the applied phosphor thereon.

Figure 3:
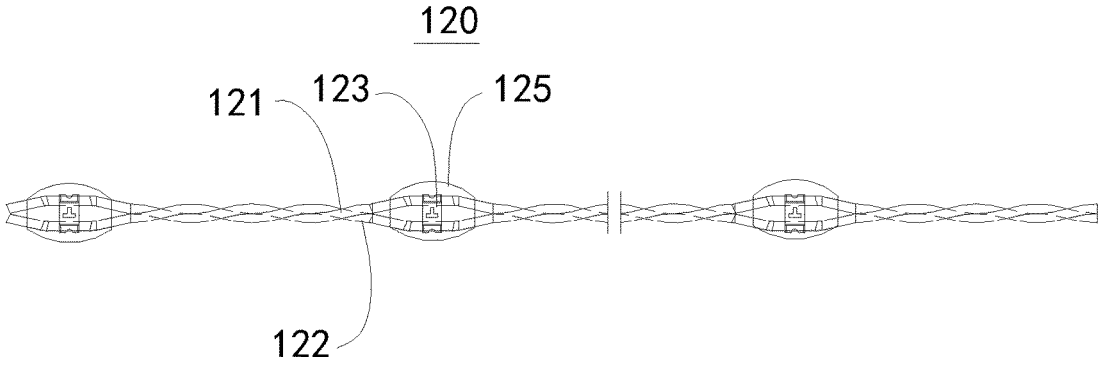
FIG. 3 is a structural schematic view of an electrodeless surface-mounted LED string light in another embodiment of the present disclosure.

FIG. 3 is a structural schematic view of an electrodeless surface-mounted LED string light according to a second embodiment of the present disclosure. As shown in FIG. 3, it differs from the above embodiment in that the first wire 121 and the second wire 122 of the electrodeless surface-mounted LED string light are intertwisted with each other.

Figure 4:
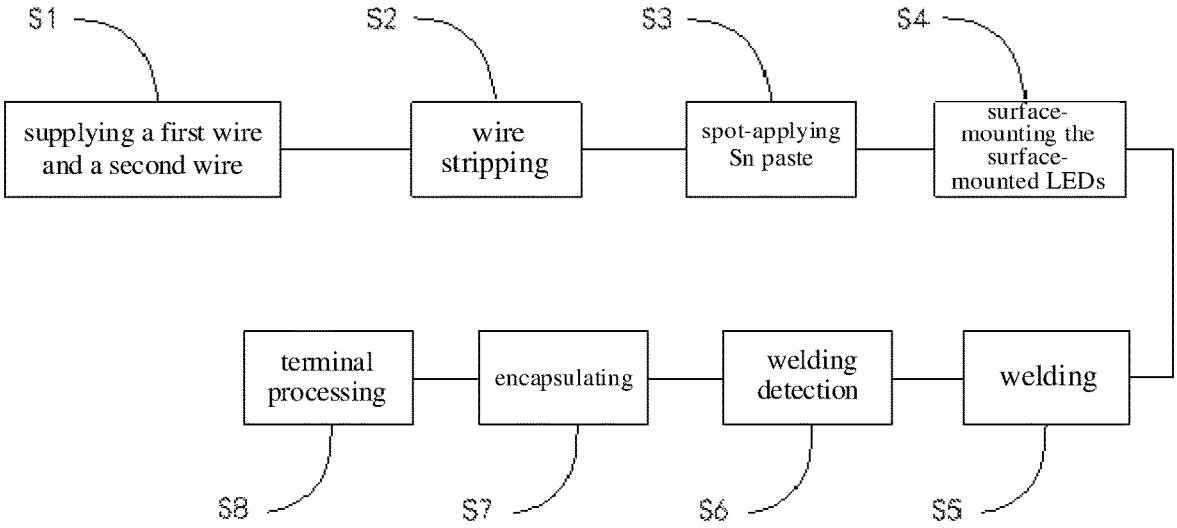
FIG. 4 is a flowchart of a method for manufacturing the electrodeless surface-mounted LED string light in an embodiment of the present disclosure.

In one embodiment of the present disclosure, there provides a method for automated manufacturing the LED string light. As shown in FIG. 4, the method includes the following steps:

Step S1, supplying a first wire and a second wire. The first wire and the second wire are supplied by a wire supply mechanism.

Step S2, a wire stripping. The first wire and the second wire are transported to a stripping station by a wire transporting mechanism. The insulating layers on surfaces of the first wire 121 and the second wire 122 are stripped off at a set interval by a wire stripping mechanism, to form first and second welding spots. The positions of the first welding spots are in one-to-one correspondence with the positions of the second welding spots, to form welding light regions.

Step S3, spot-applying a welding material. The first welding spots and the second welding spots are transported to a spot-welding material station by the wire transporting mechanism. Welding materials are applied to surfaces of the first welding spots and the second welding spots by a spot-welding material mechanism.

Step S4, surface-mounting the surface-mounted LEDs. The first welding spots and the second welding spots of which surfaces are applied with the welding materials are transported to a LED surface-mounting station by the wire transporting mechanism. The first surface-mounted LEDs 123 and the second surface-mounted LEDs 124 are placed at the welding light regions by a LED placing mechanism. The luminous surfaces of the first surface-mounted LEDs 123 are opposite to the luminous surfaces of the second surface-mounted LEDs 124. The luminous surfaces of the first surface-mounted LEDs 123 face the upper side of the welding light regions, the luminous surfaces of the second surface-mounted LEDs 124 face the lower side of the welding light regions. The positions of the positive electrodes and the negative electrodes of the first surface-mounted LEDs 123 and the second surface-mounted LEDs 124 are oppositely disposed. In particular, the first surface-mounted LEDs with luminous surfaces facing upward are supplied by a first feeding assembly; a robotic suction assembly is configured to suction the first surface-mounted LEDs from the first feeding assembly, and surface-mount the first surface-mounted LEDs at the upper side of the welding light regions; the second surface-mounted LEDs with luminous surfaces facing downward are supplied by a second feeding assembly; the robotic suction assembly is configured to suction the second surface-mounted LEDs from the second feeding assembly, and surface-mount the second surface-mounted LEDs at a transition location; and a second surface-mounted LED surface-mounting assembly acquires the second surface-mounted LEDs from the transition location and surface-mounts the second surface-mounted LEDs at the lower side of the welding light regions.

Step S5, welding. The first surface-mounted LEDs 123 and the second surface-mounted LEDs are transported to a welding station by the wire transporting mechanism. The positive and negative electrodes of the first surface-mounted LED 123 and the second surface-mounted LED 124 are welded with the first welding spots of the first wire 121 and the second welding spots of the second wire 122 by a welding mechanism, respectively.

Step S6, welding detection. The welded first surface-mounted LEDs 123 and the welded second surface-mounted LEDs 124 are transported to a welding detection station by the wire transporting mechanism, and then a welding detection mechanism performs a detection on welding quality of the surface-mounted LEDs.

Step S7, encapsulating. The first surface-mounted LEDs 123 and the second surface-mounted LEDs 124 after detecting are transported to an encapsulating station by the wire transporting mechanism, and the first surface-mounted LEDs 123 and the second surface-mounted LEDs are encapsulated in the encapsulants 125 by an encapsulating mechanism to form lighting beads.

Step S8, terminal processing. A subsequent processing is performed on the string light.

According to the method for manufacturing the electrodeless surface-mounted LED string light provided by the present disclosure, the full-auto manufacture online of the electrodeless surface-mounted LED string light are achieved, and the manufacturing efficiency and quality are significantly improved, while the cost is reduced.

Figure 5:
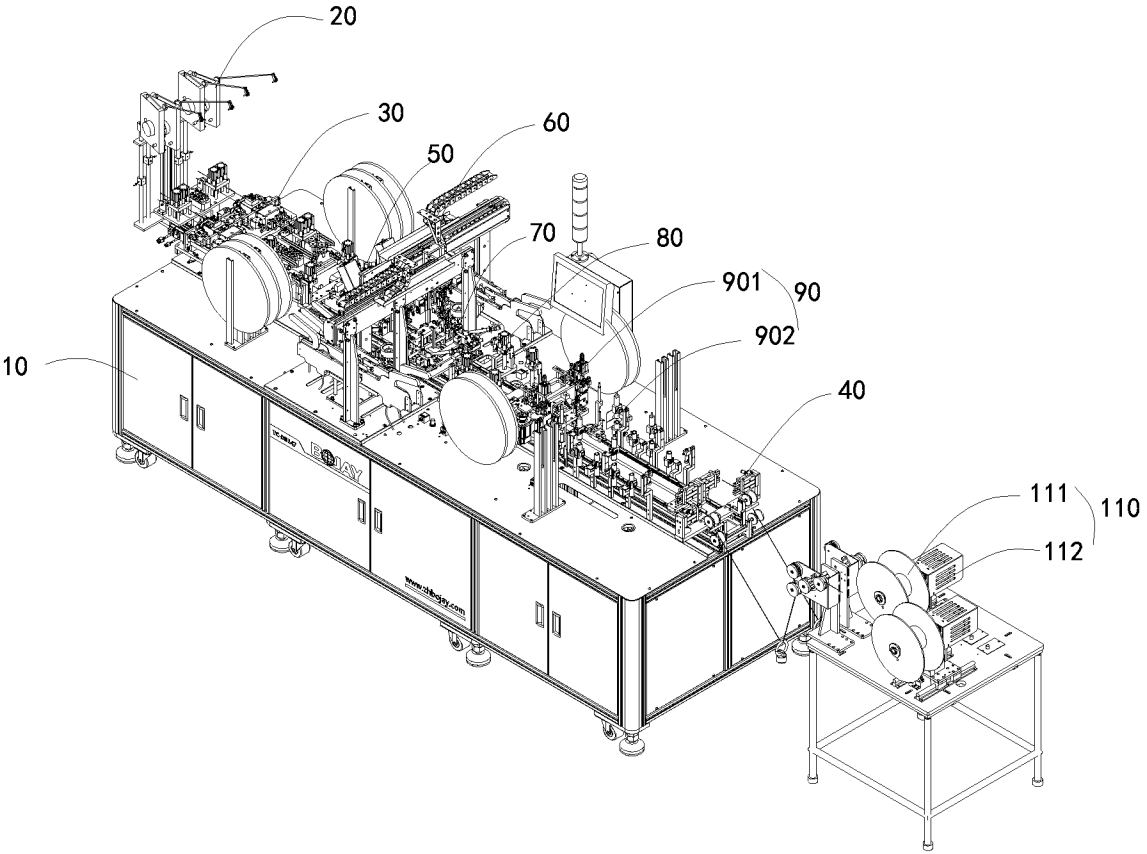
FIG. 5 is an axonometric view of an apparatus for manufacturing the electrodeless surface-mounted LED string light in an embodiment of the present disclosure.

In another embodiment of the present disclosure, there provides an apparatus for manufacturing the electrodeless surface-mounted LED string light. As shown in FIG. 5, the apparatus for manufacturing the electrodeless surface-mounted LED string light includes a wire supply mechanism 20, a wire stripping mechanism 30, a spot-welding material mechanism 50, a LED placing mechanism 60, a welding mechanism 70, a detection mechanism 80, an encapsulating mechanism 90 and a wire transporting mechanism 40. The wire supply mechanism 20, the wire stripping mechanism 30, the spot-welding material mechanism 50, the LED placing mechanism 60, the welding mechanism 70, the detection mechanism 80, the encapsulating mechanism 90 and the wire transporting mechanism 40 are in a pipelined linear arrangement, and form a full-auto manufacture line of LEDs. In one embodiment, the apparatus for manufacturing the electrodeless surface-mounted LED string light further includes a support frame 10 for supporting the wire supply mechanism 20, the wire stripping mechanism 30, the spot-welding material mechanism 50, the LED placing mechanism 60, the welding mechanism 70, the detection mechanism 80, the encapsulating mechanism 90 and the wire transporting mechanism 40.

Preferably, the apparatus for manufacturing the electrodeless surface-mounted LED string light in the embodiment includes two full-auto manufacture line of LEDs arranged side by side. In this way, two electrodeless surface-mounted LED string light may be manufactured simultaneously, and thus the manufacturing efficiency is significantly improved.

The wire supply mechanism 20 is configured to supply the first wire 121 and the second wire 122. The wire supply mechanism 20 in the embodiment includes a tension controller. The tension controller is configured to provide a reversed tension in a wire supplying direction for the first wire 121 and the second wire 122, so as to cause the wires to be in a tensioning state by cooperating with a wire clamping assembly.

The wire stripping mechanism 30 is configured to strip off the insulating layers on the surfaces of the first wire 121 and the second wire 122 at a set interval to form the first welding spots and the second welding spots. The wire stripping mechanism 30 in the embodiment includes the wire clamping assembly and a wire stripping knife assembly. The wire clamping assembly is configured to position and clamp the first wire 121 and the second wire 122, so as to provide a positioning basis when the wires are stripping off. The wire clamping assembly in the embodiment includes a front wire clamping mechanism and a rear wire clamping mechanism arranged to be opposite at a certain interval along a moving direction of the first wire 121 and the second wire 122. In one embodiment, both of the front and rear wire clamping mechanism include a spacer, a briquetting above the spacer and a cylinder for driving the briquetting to move up and down with respect to the spacer. The wire stripping knife assembly is positioned between the front wire clamping mechanism and the rear wire clamping mechanism, and is configured to strip off the insulating layers on the surfaces of the first wire 121 and the second wire 122 where the welding is to be performed, to form the first welding spots and the second welding spots. The wire stripping knife assembly is an assembly known in the art, and the redundant description thereof will not be further described herein.

The spot-welding material mechanism 50 is configured to apply the welding materials onto the first welding spots and the second welding spots of the first wire 121 and the second wire 122. The spot-welding material mechanism 50 in the embodiment includes a visual positioning assembly, a wire positioning assembly and a tin spot-applying assembly. The visual positioning assembly and the wire positioning assembly are configured to accurately position the first welding spots and the second welding spots of the first wire 121 and the second wire 122. The tin spot-applying assembly is configured to apply welding materials onto the first welding spots and the second welding spots of the first wire 121 and the second wire 122. In one embodiment, the tin spot-applying assembly includes a tin spot-welding syringe positioned above the first wire 121 and the second wire 122 and an air-supplying device for supplying air to the sin spot-welding syringe.

The LED placing mechanism 60 is configured to surface-mount the first surface-mounted LEDs 123 in the welding light regions firstly, wherein the positive electrodes of the first surface-mounted LEDs 123 are surface-mounted on the first welding spots of the first wire 121 and the negative electrodes of the first surface-mounted LEDs 123 are surface-mounted on the second welding spots of the second wire 122, and then the luminous surfaces of the second surface-mounted LEDs 124 and the luminous surfaces of the first surface-mounted LEDs 123 are surface-mounted back-to back in the welding light regions. The positive electrodes of the second surface-mounted LEDs 124 are surface-mounted on the second welding spots of the second wire 122, the negative electrodes of the second surface-mounted LEDs 124 are surface-mounted on the first welding spots of the first wire 121.

Figure 6:
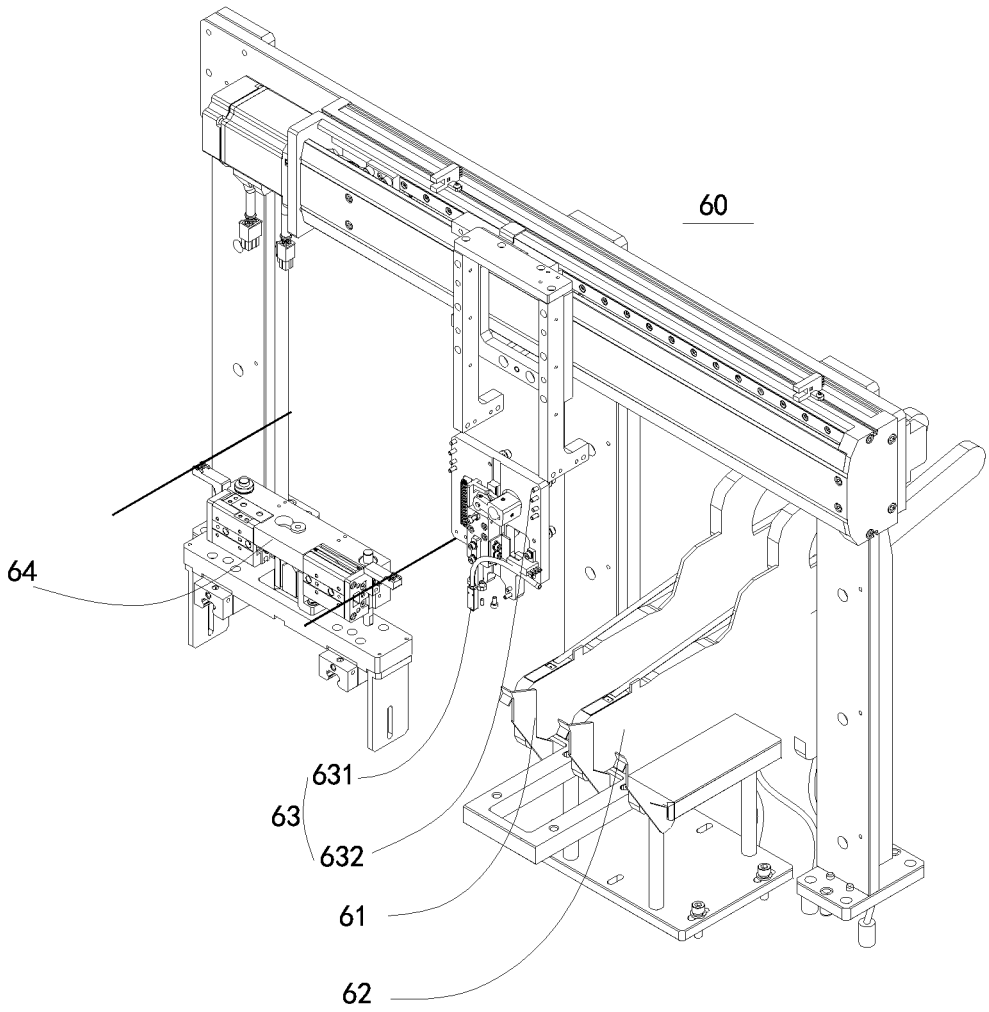
FIG. 6 is a perspective view of a LED placing mechanism of the apparatus for manufacturing the electrodeless surface-mounted LED string light in an embodiment of the present disclosure.

FIG. 6 is a perspective view of a LED placing mechanism 60 in an embodiment of the present disclosure. As shown in FIG. 6, the LED placing mechanism 60 includes a first feeding assembly 61, a second feeding assembly 62, a robotic suction assembly 63 and a second surface-mounted LED surface-mounting assembly 64. The feeding assembly 61 is configured to supply the first surface-mounted LEDs 123. The second feeding assembly 62 is configured to supply the second surface-mounted LEDs 124. The luminous surface of the second surface-mounted LEDs 124 is opposite to the luminous surface of the first surface-mounted LEDs 123. The robotic suction assembly 63 is configured to suction the first surface-mounted LEDs 123 from the first feeding assembly 61, and surface-mounting the first surface-mounted LEDs 123 at the upper side of the welding light regions. The robotic suction assembly 63 is further configured to suction the second surface-mounted LEDs 124 from the second feeding assembly 62, and placing the second surface-mounted LEDs 124 at the transition location. The robotic suction assembly 63 in the embodiment includes a suction rod 631 and a robot 632. The suction rod 631 is configured to suction the surface-mounted LEDs by means of a vacuum generating device. The robot 632 is configured to drive the suction rod 631 to reciprocate between the feeding assembly and a transit positioning assembly.

Figure 7:
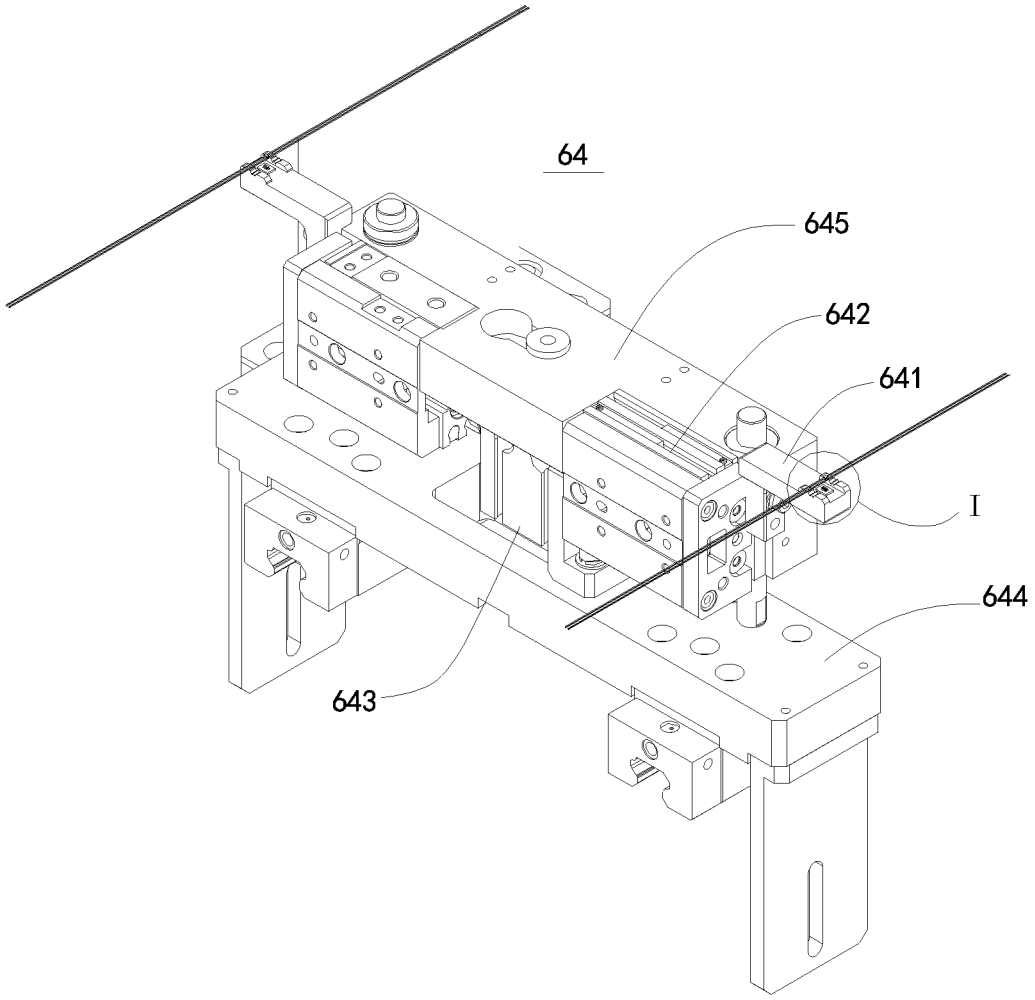
FIG. 7 is a perspective view of a surface-mounting assembly of a second surface-mounted LED in an embodiment of the present disclosure.
Figure 8:
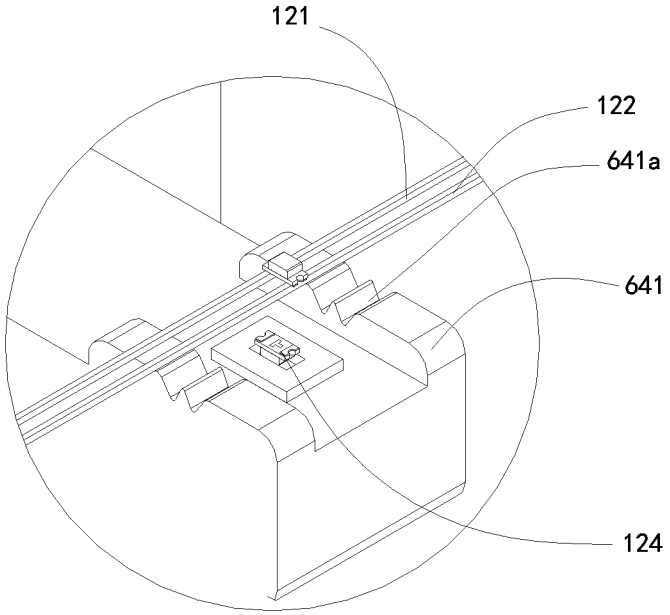
FIG. 8 is a partially enlarged schematic view of portion I of FIG. 7.

The second surface-mounted LED surface-mounting assembly 64 is configured to acquire the second surface-mounted LEDs 124 from the transition location, and surface-mounting the second surface-mounted LEDs 124 at the lower side of the welding light regions. As shown in FIGS. 7 and 8, the second surface-mounted LED surface-mounting assembly 64 includes a positioning block 641 and a positioning block driving device 641. The positioning block 641 is provided with a placement site for placing the second surface-mounted LEDs 124. The positioning block 641 may move between the transition location and a surface-mounting location. The positioning block driving device 641 is configured to drive the positioning block 641 to move between the transition location and the surface-mounting location. In the embodiment, the driving device for positioning block 641 includes a translation cylinder 642 and a lifting cylinder 643. The translation cylinder 642 is mounted on a holder 645. A retractable rod of the translation cylinder 642 is connected to the positioning block 641. When the retractable rod of the translation cylinder 642 extends out, the positioning block 641 is driven to the transition location. When the retractable rod of the translation cylinder 642 is retraced, the positioning block 641 is driven to the surface-mounting location. The lifting cylinder 643 is mounted on a fixed base 644. The fixed base 644 is mounted on the support frame 10. The retractable rod of the lifting cylinder 643 is connected to the holder 645. When the positioning block 641 moves to the surface-mounting location, the retractable rod of the lifting cylinder 643 extends out to surface-mount the second surface-mounted LEDs 124 in the welding light regions.

In one embodiment, the positioning block 641 is further disposed with positioning slots 641*a* for positioning the first wire 121 and the second wire 122.

The welding mechanism 70 is configured to weld the positive and negative electrodes of the first surface-mounted LEDs 123 and the second surface-mounted LEDs 124 with the first welding spots of the first wire 121 and the second welding spots of the second wire 122, respectively. The welding mechanism 70 may adopt a laser welding, a hot gas welding and the like.

The detection mechanism 80 is configured to detect the welding quality of the surface-mounted LEDs. The detection mechanism 80 includes an on-off assembly and a photosensitive detection assembly. The on-off assembly is configured to provide voltage between the first wire 121 and the second wire 122. The photosensitive detection assembly determines the lighting of welding of the LED by using a photosensitive detection or a visual inspection, and signals the good and the defective.

The encapsulating mechanism 90 is configured to encapsulate the first surface-mounted LEDs 123 and the second surface-mounted LEDs 124 in the encapsulant 125 to form the lighting beads. The encapsulating mechanism 90 in the present embodiment includes an encapsulant spot-applying mechanism 901 and a curing mechanism 902. The encapsulant spot-applying mechanism 901 is configured to apply the encapsulants onto the surfaces of the surface-mounted LEDs. The curing mechanism 902 is configured to curing the encapsulants in a liquid state on the surfaces of the surface-mounted LEDs. The curing mechanism 902 in the embodiment rapidly cures the encapsulants in the liquid state of the previous process by using the UV cured principle. Preferably, the curing mechanism 902 includes a pre-curing assembly and a secondary curing assembly, which are arranged in sequence in a direction in which the wires are supplied. The pre-curing assembly and the secondary curing assembly each include a UV lighting and a blow-sizing device arranged up and down. The UV lighting is configured to irradiate the encapsulants in the liquid state applied on the surface-mounted LEDs. The blow-sizing device output airflow to blow-size and pre-cure the encapsulants in the liquid state, so as to maintain the welding strength of the wires of the lighting beads, and ensure the insulation of the lighting beads and the wires from the outside. The pre-curing assembly is configured to size and cure the encapsulant preliminarily, and the secondary curing assembly is configured to further cure the preliminary sized and cured encapsulant, so as to ensure the welding strength between the surface-mounted LEDs and the wires.

The wire transporting mechanism 40 is configured to provide power for the travel of the wire. The wire transporting mechanism 40 in the embodiment includes a plurality of linear single-axis robots and a plurality of pneumatic fingers. The plurality of linear single-axis robots are arranged at an interval along the direction in which the wires are supplied, so as to provide power for drawing a linear wire and provide a mounting platform for the pneumatic fingers. The plurality of pneumatic fingers are respectively disposed on the plurality of linear single-axis robots, functioning as positioning and clamping the wires.

In one embedment, the apparatus for manufacturing the electrodeless surface-mounted LED string light further includes a terminal processing mechanism 110. The terminal processing mechanism 110 is configured to perform subsequent processing on the processed surface-mounted LEDs. The terminal processing mechanism 110 in the embodiment includes a wire take-up device. The wire take-up device includes a wire take-up wheel 111 and a wire take-up motor 112 for driving the wire take-up wheel 111 to rotate. The finished LED string light is wound around the wire take-up wheel 111 to form a bobbin. In addition to the wire take-up device, the terminal processing mechanism 110 may also be a wire-stranding device, a wire-trimming device and the like. A type of LED string light having stranded wires may be accomplished by the wire-stranding device. A type of LED string light having any lengths may be accomplished by the wire-trimming device.

The above embodiments merely illustrate several embodiments of the present disclosure, although the description thereof is more specific and detailed, but those are not to be construed as limiting the scope of the disclosure. It should be noted that a number of variations and modifications may be made by those skilled in the art without departing from the concept of the disclosure, those are fallen in the protection scope of the disclosure.

What is claimed is:

1. An electrodeless surface-mounted LED string light, comprising:

a first wire and a second wire arranged side by side or intertwisted with each other, wherein each of the first wire and the second wire comprises a wire core and an insulating layer covered on a surface of the wire core; a plurality of first welding spots, where the insulating layer is stripped, are formed on the first wire at a set interval along an axial direction thereof; a plurality of second welding spots, where the insulating layer is stripped, are formed on the second wire at a set interval along an axial direction thereof, and wherein positions of the plurality of the second welding spots are in one-to-one correspondence with positions of the plurality of the first welding spots so as to form a plurality of welding light regions;

a plurality of LED units disposed at the plurality of welding light regions, respectively, wherein each LED unit comprises a first surface-mounted LED and a second surface-mounted LED, and wherein a luminous surface of the first surface-mounted LED is opposite to a luminous surface of the second surface-mounted LED, the luminous surface of the first surface-mounted LED faces an upper side of the welding light regions, the luminous surface of the second surface-mounted LED faces a lower side of the welding light regions, such that the light emitted by each of the first and second surface-mounted LEDs is perpendicular to the axial direction of each of the first and second wires and perpendicular to a plane where the corresponding welding light region presents; positions of positive electrodes and negative electrodes of the first surface-mounted LED and the second surface-mounted LED are oppositely disposed, and wherein two weld legs of the first surface-mounted LED and the second surface-mounted LED of each LED unit are respectively welded onto the first and second welding spots of the corresponding welding light region; and a plurality of encapsulants respectively covered on surfaces of the two surface-mounted LEDs of the plurality of LED units, to form a plurality of lighting beads.

2. The electrodeless surface-mounted LED string light according to claim 1, wherein the two surface-mounted LEDs of the LED unit are provided to have different colors.

3. The electrodeless surface-mounted LED string light according to claim 1, wherein the first wire and the second wire are rubber wires or enameled wires.

* * * * *